US012735245B2

(12) United States Patent
Ong

(10) Patent No.: US 12,735,245 B2
(45) Date of Patent: Sep. 15, 2026

(54) AEROSOL CONTAINER WITH AEROSOL VALVE ASSEMBLIES

(71) Applicant: Samurai 2K Aerosol Sdn. Bhd., Johor Bahru (MY)

(72) Inventor: Yoke En Ong, Johor Bahru (MY)

(73) Assignee: Samurai 2K Aerosol Sdn. Bhd., Lima Kedai (MY)

( * ) Notice: Subject to any disclaimer, the term of this patent is extended or adjusted under 35 U.S.C. 154(b) by 134 days.

(21) Appl. No.: 18/853,827

(22) PCT Filed: Jul. 26, 2022

(86) PCT No.: PCT/MY2022/050067
§ 371 (c)(1),
(2) Date: Oct. 3, 2024

(87) PCT Pub. No.: WO2023/195843
PCT Pub. Date: Oct. 12, 2023

(65) Prior Publication Data

US 2025/0236452 A1 Jul. 24, 2025

(30) Foreign Application Priority Data

Apr. 4, 2022 (MY) ..... PI2022001764

(51) Int. Cl.
*B65D 83/384* (2025.01)
*B65D 83/32* (2006.01)
(Continued)

(52) U.S. Cl.
CPC ..... *B65D 83/48* (2013.01); *B65D 83/32* (2013.01); *B65D 83/382* (2013.01); *B65D 83/384* (2013.01); *B65D 83/425* (2013.01)

(58) Field of Classification Search
CPC .... B65D 83/32; B65D 83/382; B65D 83/384; B65D 83/40; B65D 83/42; B65D 83/425;
(Continued)

(56) References Cited

U.S. PATENT DOCUMENTS 2,947,449 A * 8/1960 Hernandez ..... B65D 83/68 222/386.5
3,074,601 A 1/1963 Kuffer
(Continued)

FOREIGN PATENT DOCUMENTS

| | | |
|---|---|---|
| CN | 104609045 | 5/2015 |
| WO | 2019231312 | 12/2019 |
| WO | 2020242287 | 12/2020 |

OTHER PUBLICATIONS

English Abstract of CN104609045.
(Continued)

*Primary Examiner* — Paul R Durand
*Assistant Examiner* — Randall A Gruby
(74) *Attorney, Agent, or Firm* — Preston Smirman; SMIRMAN IP LAW, PLLC

(57) ABSTRACT

The invention intends to provide an aerosol container comprising a body (100) that includes an outer chamber (110*a*) having a first open end and a second open end, and an inner chamber (120*a*) positioned within the outer chamber (110*a*) and enclosing the first open end of the outer chamber (110*a*), the inner chamber (120*a*) having a divider (121) that separates it from the outer chamber (110*a*), and an opening, a puncture member (300) for rupturing the divider (121), a first aerosol valve assembly (2100) enclosing the opening of the inner chamber (120*a*) and including any one or a combination of a content-filling mechanism, gas-discharging mechanism, rupturing mechanism and a first content-dispensing mechanism, and a second aerosol valve assembly
(Continued)

(2200) enclosing the second open end of the outer chamber (110*a*) having a second content-dispersing mechanism.

26 Claims, 11 Drawing Sheets

(51) Int. Cl.
*B65D 83/38* (2006.01)
*B65D 83/42* (2006.01)
*B65D 83/48* (2006.01)

(58) Field of Classification Search
CPC .... B65D 83/48; B65D 83/666; B65D 83/685; B65D 83/687; B65D 83/70; B05B 15/25
See application file for complete search history.

(56) References Cited

U.S. PATENT DOCUMENTS 3,080,094 A * 3/1963 Modderno ..... B65D 83/687 222/464.5
3,559,701 A * 2/1971 Wittersheim ..... B65D 83/42 141/303
3,613,960 A * 10/1971 Beard ..... B65D 83/42 222/402.1
3,630,415 A * 12/1971 Morane ..... B65D 83/666 222/129
4,174,811 A * 11/1979 Binder ..... B65D 83/66 222/402.18
4,613,061 A * 9/1986 Meuresch ..... B65D 83/425 222/541.2
4,769,395 A * 9/1988 Pauls ..... B65D 83/687 521/137
5,179,982 A * 1/1993 Berube ..... B65D 83/38 222/105
5,638,992 A * 6/1997 Lim ..... B65D 83/687 222/402.1
6,196,421 B1 * 3/2001 Williams ..... B65D 83/68 222/402.1
7,204,392 B2 * 4/2007 Kwasny ..... B65D 83/687 222/394
7,870,976 B2 * 1/2011 Fazekas ..... B65D 83/64 222/394
8,403,177 B2 * 3/2013 Kwasny ..... B65D 83/42 222/394
8,596,502 B2 * 12/2013 Kwasny ..... B65D 83/687 222/402.21
9,926,129 B2 * 3/2018 Ong ..... B65D 83/682
11,148,872 B2 * 10/2021 Bürkle ..... B65D 83/687
11,845,606 B2 * 12/2023 Saw ..... B65D 83/687
2006/0219737 A1 * 10/2006 Larkin ..... B01F 33/453 366/274
2014/0252029 A1 * 9/2014 Kallgren ..... B65D 83/62 53/410
2024/0409300 A1 * 12/2024 Ong ..... B65D 83/40
2024/0409301 A1 * 12/2024 Ong ..... B65D 83/40
2025/0256910 A1 * 8/2025 Lambertson, Jr. ..... B65D 83/40

OTHER PUBLICATIONS

International Preliminary Report on Patentability Dated May 14, 2024.
Written Opinion of the International Searching Authority Dated Dec. 13, 2022.
Written Opinion of the International Search Report Dated Dec. 13, 2022.

* cited by examiner

AEROSOL CONTAINER WITH AEROSOL VALVE ASSEMBLIES

CROSS-REFERENCE TO RELATED APPLICATION

The instant application is a national phase of PCT International Application No. PCT/MY2022/050067 filed Jul. 26, 2022, and claims priority to Malaysian Patent Application Serial No. PI2022001764 filed Apr. 4, 2022, the entire specifications of both of which are expressly incorporated herein by reference.

FIELD OF INVENTION

The invention relates to an aerosol container having more than one aerosol valve assembly. More particularly, the invention relates to an aerosol container having a first aerosol valve assembly that can support filling of content, degassing of air from the aerosol container, coalescing of content and dispensing of content, and a second aerosol valve assembly that can support dispensing of content.

BACKGROUND OF THE INVENTION

An aerosol container typically comprises a metal container body and an aerosol valve assembly, wherein the body stores content such as a payload and propellant, while the aerosol valve assembly provides a "gate" for the said content to enter or exit the aerosol container. The payload may be, but shall not be limited to, single-component paint or multi-component paint. In the case of multi-component paint, all components are preferably coalesced, or mixed, prior to being dispensed. The propellant may be, but shall not be limited to, pressurized air or hydrocarbons. The propellant is stored in the aerosol can at high pressure, so that exert a pressure force for the payload to be dispensed through a nozzle when the aerosol valve assembly is actuated by an actuator.

The aerosol valve assembly is mounted onto the body through the support of a mounting cup. It further comprises a housing, a resilient means such as a spring, and a gasket. A stem is used to form a path in the aerosol valve assembly. When an actuator of the aerosol container is pressed, the resilient means is compressed with the stem is displaced downwardly away from the gasket, and the content shall be dispensed due to pressure differences. When the actuator is un-pressed, the resilient means is de-compressed with the stem is displaced upwardly back to the upward position, preventing the content from being dispensed.

The aerosol valve assembly may come as a male-type or female-type. In the male-type aerosol valve assembly, the stem is integrated therein, protruding outwardly from the housing and the mounting cup. Whereas in a female-type aerosol valve assembly, the stem is integrated with the actuator, and it is to be inserted into the housing of the aerosol valve assembly.

The stem of male-type aerosol valves tends to bend or break during the aerosol container manufacturing process, especially during the stage of crimping and filling of content through the aerosol valve assembly. This will render the aerosol container unusable. Therefore, it is preferable that a female-type aerosol valve is used, as it shall reduce the failure rate during the manufacturing process.

There are a few patented technologies over the prior art that relate to an aerosol valve assembly. Among them is U.S. Pat. No. 3,074,601, which discloses a kind of female-type aerosol valve assembly that includes a removable dispensing tip on its actuator that may be interchanged with another similar tip to discharge the content of the container either in the form of a stream, a spray or as foam, depending upon the nature of the product in the container.

Another patented technology is U.S. Pat. No. 3,613,960, which discloses a kind of aerosol container having a female-type valve assembly that allows for refilling of the content to take place. It is capable of being filled with payload and propellant up to a predetermined level, and further comprises a cylindrical shell having a first annular disc connected to one end of the shell and a second annular disc connected to the other end of the shell. A first valve cap having a two-way dual-purpose valve positioned therein for receiving and dispensing liquids is connected to the first annular disc and a second valve cap having a second dual-purpose valve located therein for dispensing excess gases is connected to the second annular disc. Nozzle heads may be added to the dual-purpose valves so that the valves can be used to spray liquids.

Even so, the aforementioned patented technologies that relate to the female-type aerosol valve assemblies lack multi-function capabilities. The valve assembly in U.S. Pat. No. 3,074,601 can only dispense content, while U.S. Pat. No. 3,613,960 requires the use of two separate valve assemblies at two ends of the aerosol container so that the refilling of content, dispensing of content and degassing of the container can be done. Moreover, both prior arts are not configured to be integrated into an aerosol container having a single-component payload or multi-component payload.

No solutions were disclosed by the aforementioned patents that can provide a kind of universal aerosol valve assembly that can support filling of content, degassing of air from the aerosol container, coalescing of content and dispensing of content. Accordingly, it would be desirable to have an aerosol valve assembly of the female type that can support the aforementioned functionalities, especially for an aerosol container having a single-component payload or multi-component payload. It may also be desirable to have an aerosol container with an additional dispensing passage to dispense content from the aerosol container.

SUMMARY OF INVENTION

The main objective of the invention is to provide an aerosol container having more than one aerosol valve assembly. In particular, the invention provides an aerosol container having a first aerosol valve assembly, preferably of the female type, that can support filling of content, degassing of air from the aerosol container, coalescing of content, and dispensing of content, and a second aerosol valve assembly, preferably of the male type, that can support dispensing of content.

To achieve this objective, the first aerosol valve assembly is configured so that it can receive a detachable component that shall allow the first aerosol valve assembly to activate a content-filling mechanism for filling content, a gas-discharging mechanism for degassing the container, a rupturing mechanism for coalescing the content, a first content-dispensing mechanism for dispensing content, or any combination thereof, while the second aerosol valve assembly is configured to receive a detachable component that shall allow the second aerosol valve assembly to activate a second content-dispensing mechanism for dispensing content.

Advantageously, the first aerosol valve assembly of the present invention can avoid damage to the stem during further aerosol container manufacturing process lines while also being compatible with aerosol containers having single-component payload or multi-component payload. The most significant improvement of the invention is that the process of filling, dispensing, degassing and component coalescing can be done using the same first aerosol valve assembly.

Advantageously, the second aerosol valve assembly of the present invention can provide an additional dispensing passage to dispense content from the aerosol container. The content of the outer chamber can also be dispensed prior to coalescing with content of the inner chamber. Advantageously as well, the dip tube connected to the second aerosol valve assembly can ensure content at the edges of the outer chamber would be dispensed, therefore not wasting any content filled within the aerosol container.

Advantageously, the aerosol container of the present invention having at least a content-filling mechanism allows for refilling of content, which includes payload or propellent, into the aerosol container, thereby making the aerosol container reusable even upon rupturing of the divider.

The present invention intends to provide an aerosol container comprising a body that includes an outer chamber having a first open end and a second open end, and an inner chamber positioned within the outer chamber and enclosing the first open end of the outer chamber, the inner chamber having a divider that separates it from the outer chamber, and an opening, a puncture member for rupturing the divider, a first aerosol valve assembly enclosing the opening of the inner chamber and including any one or a combination of a content-filling mechanism, gas-discharging mechanism, rupturing mechanism and a first content-dispensing mechanism, and a second aerosol valve assembly enclosing the second open end of the outer chamber having a second content-dispersing mechanism. Upon activation of the first aerosol valve assembly, the content-filling mechanism enables formation of a content-filling passage to allow external content to be added into the body, the gas-discharging mechanism enables formation of a gas-discharging passage to allow unwanted or excess gas to be released out of the body, the rupturing mechanism acts on the puncture member to rupture the divider so as to allow coalescing of content within the inner chamber and outer chamber to form a coalesced content, and the first content-dispensing mechanism enables formation of a first content-dispensing passage to dispense the content out of the body. Whereas, upon activation of the second aerosol valve assembly, the second content-dispensing mechanism enables formation of a second content-dispensing passage to dispense the content out of the body.

Preferably, the first aerosol valve assembly comprises a mounting cup mounted to the opening of the inner chamber and having an aperture, a valve housing positioned within the inner chamber and adjacent to the aperture of the mounting cup, and a valve core accommodated within the valve housing, having a cap portion, a valve shaft connected to the cap portion, and an inlet formed between the cap portion and the valve shaft where the valve shaft is movable within the valve core to expose or close the inlet.

Preferably, the first aerosol valve assembly further comprises a detachable component inserted into the aperture of the mounting cup, being either a content-filling device having a content-filling stem, a gas-discharging device having a discharge activation stem, a content-filling and gas-discharging device having a content-filling and a discharge activation stem, a rupturing device having a rupture activation stem, a first content-dispensing device having a content-dispensing activation stem, or any combination thereof.

Preferably, the content-filling mechanism of the first aerosol valve assembly includes the valve shaft, and the valve core with the cap portion being configured to receive the content-filling stem therethrough for supplying the external content into the valve core while pushing the valve shaft to expose the inlet of the valve core for directing the external content through the valve core and into the inner chamber.

Preferably, the content-filling passage includes the content-filling device, the valve core of the first aerosol valve assembly, a channel formed by a dip tube within the puncture member that is connected to the valve core of the first aerosol valve assembly, and the inner chamber.

Preferably, the gas-discharging mechanism of the first aerosol valve assembly includes the valve shaft, and the valve core with the cap portion configured to receive the discharge activation stem for moving the valve core away from the aperture of the mounting cup to create a gap therebetween to allow exit of the unwanted or excess gas from the body of the aerosol container through the gas-discharging device.

Preferably, the gas-discharging passage includes, either or both, a combination of the inner chamber, the valve housing of the first aerosol valve assembly and discharge conduits within the gas-discharging device, and a combination of the inner chamber, a passageway formed between the puncture member and the valve housing of the first aerosol valve assembly, the valve core of the first aerosol valve assembly, and the discharge conduits of the gas-discharging device.

Preferably, the content-filling mechanism and gas-discharging mechanism of the first aerosol valve assembly are configured to operate simultaneously upon activation of the first aerosol valve assembly by the content-filling and discharge activation stem which allows the external content to be supplied from the stem through the cap portion while moving the valve shaft to expose the inlet of the valve core for directing the external content into the valve core, and moving the valve core away from the aperture of the mounting cup to create a gap therebetween to allow exit of the unwanted or excess gas from the body of the aerosol container through the content-filling and gas-discharging device.

Preferably, the rupturing mechanism of the first aerosol valve assembly includes the valve core, and the valve housing which sits within a recess formed at one end of the puncture member that is slidable along the valve housing such that upon activation of the first aerosol valve assembly by the rupturing activation stem, its valve core is pushed to displace the puncture member towards the direction of the divider to rupture it.

Preferably, the puncture member of the aerosol container further comprises a dip tube forming a channel inside the puncture member that moves along with the puncture member to reach the outer chamber upon rupturing the divider.

Preferably, the first aerosol valve assembly has its valve core configured to substantially or fully return to its original position within the valve housing upon removal of the rupture activation stem, which disconnects the valve core and the channel of the puncture member, forming a cavity within the puncture member by having the recess covered by the valve housing.

Preferably, the first content-dispensing mechanism of the first aerosol valve assembly includes the valve housing, and the valve core with the cap portion being configured to receive the content-dispensing activation stem that displaces the valve core away from the aperture of the mounting cup, leaving a gap therebetween to allow content to be dispensed out of the aerosol container through the first content-dispensing device.

Preferably, the puncture member of the aerosol container is formed with a recess at one end that is covered by the valve housing to create a cavity within the puncture member, and has a dip tube forming a channel inside the puncture member.

Preferably, the first content-dispensing passage includes the body of the aerosol container, the channel within the puncture member, the cavity of the puncture member, the valve housing of the first aerosol valve assembly, conduits between the cap portion of the valve core of the first aerosol valve assembly and the content-dispensing activation stem of the first content-dispensing device, and the first content-dispensing device.

Preferably, the content-dispensing activation stem of the first content-dispensing device is formed with a dimension to fix the position of the valve core of the first aerosol valve assembly during formation of the gap.

Preferably, the second aerosol valve assembly comprises a mounting cup mounted to the second open end of the outer chamber, a valve housing mounted to the second open end of the outer chamber through the support of the mounting cup, a valve core accommodated within the valve housing, having a valve stem that protrudes outwardly from the valve housing and the mounting cup, and a dip tube connected to the valve housing.

Preferably, the second aerosol valve assembly further comprises a detachable component fitted over its mounting cup and its valve stem, being a second content-dispensing device having a content-dispensing activation stem.

Preferably, the second content-dispensing mechanism of the second aerosol valve assembly includes the valve core with its valve stem being configured to receive the content-dispensing activation stem of the second content-dispensing device that displaces the valve stem to allow content dispensed out of the aerosol container through the second content-dispensing device.

Preferably, the second content-dispensing passage includes the body of the aerosol container, the dip tube, the valve housing and the valve stem of the second aerosol valve assembly, the content-dispensing activation stem of the second content-dispensing device, and the second content-dispensing device.

Alternatively, the second aerosol valve assembly comprises a mounting cup mounted to the second open end of the outer chamber and having an aperture, a valve housing positioned adjacent to the aperture of the mounting cup and supported by it, a valve core accommodated within the valve housing, having a cap portion, and a valve shaft connected to the cap portion, and a dip tube connected to the valve housing.

Alternatively, the second aerosol valve assembly further comprises a detachable component inserted into the aperture of its mounting cup, being a second content-dispensing device having a content-dispensing activation stem.

Alternatively, the second content-dispensing mechanism of the second aerosol valve assembly includes its valve housing, and its valve core being configured to receive the content-dispensing activation stem of the second content-dispensing device that displaces the valve core away from the aperture of the mounting cup, leaving a gap therebetween to allow content to be dispensed out of the aerosol container through the second content-dispensing device.

Alternatively, the second content-dispensing passage includes the body of the aerosol container, the dip tube, the valve housing of the second aerosol valve assembly, conduits between the cap portion of the valve core of the second aerosol valve assembly and the content-dispensing activation stem of the second content-dispensing device, and the second content-dispensing device.

Alternatively, the content-dispensing activation stem of the second content-dispensing device is formed with a dimension to fix the position of the valve core of the second aerosol valve assembly during formation of the said gap.

Preferably, the inner chamber of the aerosol container further comprises a reinforcement structure for reinforcing structural integrity of the inner chamber.

Preferably, the aerosol container is refillable through the content-filling mechanism of the first aerosol valve assembly.

One skilled in the art will readily appreciate that the invention is well adapted to carry out the objects and obtain the ends and advantages mentioned, as well as those inherent therein. The embodiments described herein are not intended as limitations on the scope of the invention.

BRIEF DESCRIPTION OF THE DRAWINGS

To facilitate an understanding of the invention, there is illustrated in the accompanying drawing the preferred embodiments from an inspection of which when considered in connection with the following description, the invention, its construction and operation and many of its advantages would be readily understood and appreciated.

DETAILED DESCRIPTION OF THE INVENTION

Figure 1:
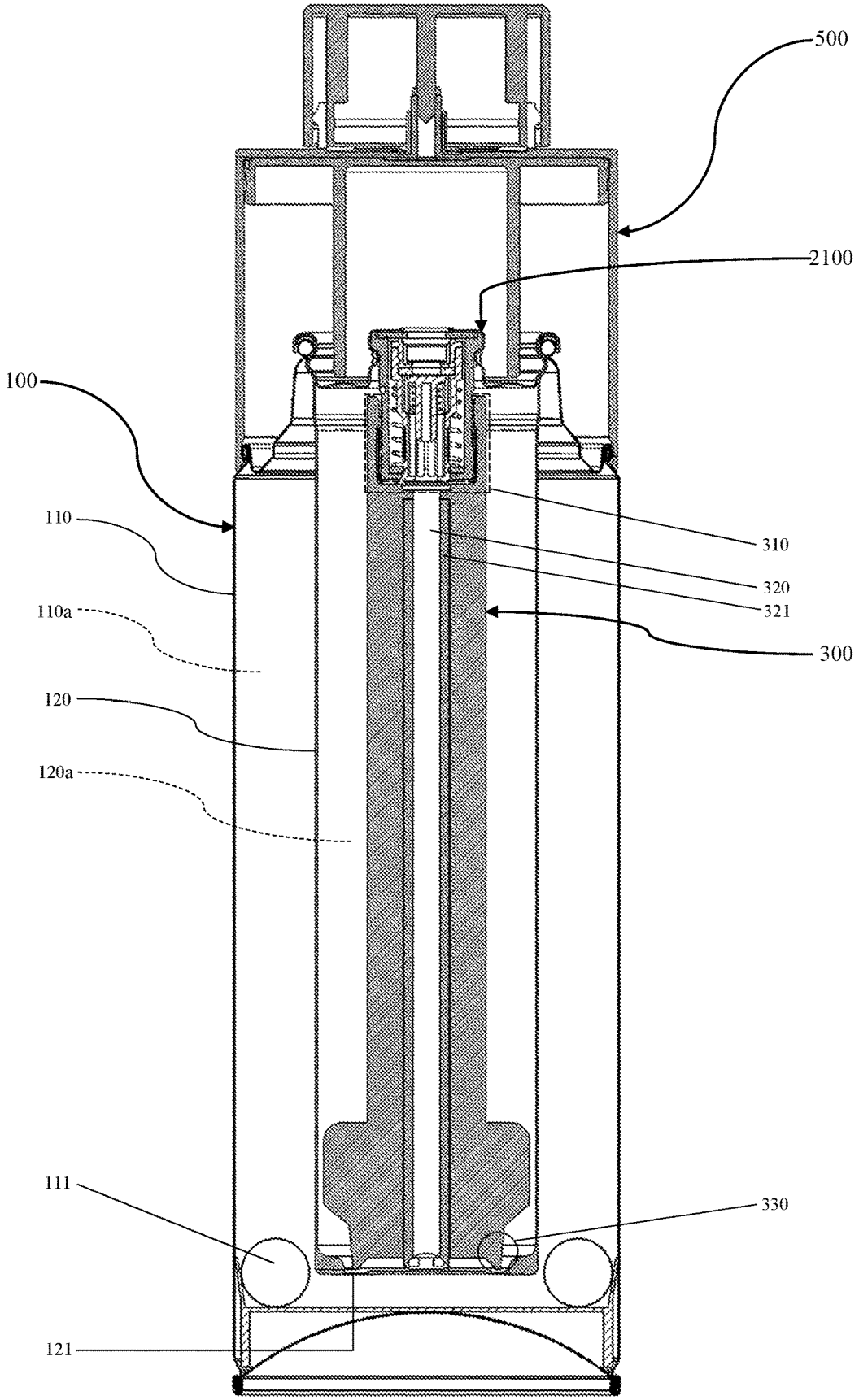
FIG. 1 is a diagram illustrating the cross-sectional view of the aerosol container, and the first aerosol valve assembly in an inert state being sealed by a fastening device.

The present invention relates to an aerosol container comprising more than one aerosol valve assembly. More particularly, the invention relates to a first aerosol valve assembly that can support filling of content, degassing of air from the aerosol container, coalescing of content and dispensing of content, as well as a second aerosol valve assembly that provides a second content-dispensing passage to dispense content. This invention is to be compatible with an aerosol container having a single-component payload or multi-component payload. The invention may also be presented in a number of different embodiments with common elements.

According to the concept of the invention, the aerosol container is preferably configured to accommodate a single-component payload or multi-component payload, with a body with an outer chamber having a first open end and a second open end, and an inner chamber positioned within the outer chamber and enclosing the first open end of the outer chamber. The aerosol container further has a first aerosol valve assembly that encloses the opening of the inner chamber and is configured to receive a detachable component that shall allow the first aerosol valve assembly to activate a content-filling mechanism for filling content, a gas-discharging mechanism for degassing the aerosol container, a rupturing mechanism for coalescing the content, a first content-dispensing mechanism for dispensing content, or any combination thereof, as well as a second aerosol valve assembly that encloses the second open end of the outer chamber, having a second content-dispensing mechanism.

From hereon, in the context of the present invention, it shall be understood that the term "content" may refer to aqueous or gaseous fluids, which may include the payload and the propellant. The payload may be multi-component having one or more paints, or any kind of pigmented liquids or fluids, mastic compositions, polyurethane enamels, or any kind of chemical compounds related to colouring applications.

In a first use case, the aerosol container has a single-component payload, or a payload with a single component. This single component may be any kind of pigmented liquids or fluids, mastic compositions, polyurethane enamels, or any kind of chemical compound related to colouring applications. Preferably, this single-component payload is stored in an inner chamber of the aerosol container. As for the propellant, it may be, but shall not be limited to pressurized air, hydrocarbons, organic compounds or the like, and is to be stored in the outer chamber.

In a second use case, the aerosol container has a multi-component payload, or a payload with multiple components. More specifically, the multi-component payload has two components, preferably being a resin component and a hardener component. Preferably, the resin component is stored in an outer chamber of the aerosol container and the hardener component is stored in an inner chamber of the aerosol container. As for the propellant, it may be, but shall not be limited to pressurized air, hydrocarbons, organic compounds or the like, and is to be stored in the outer chamber together with the resin component.

From hereon, it will be understood that, although the terms first, second, etc. may be used herein to describe various elements, components, regions, layers or sections, these elements, components, regions, layers or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

From hereon as well, spatially relative terms, such as "upper", "lower", and the like, may be used herein for ease of description to describe one element or feature's relationship to another element or feature as illustrated in the figures. It will be understood that the spatially relative terms are intended to encompass different orientations of the assembly in use or operation in addition to the orientation depicted in the figures. For example, if the assembly in the figures is turned over, elements described as "upper" other elements or features would then be oriented "below" the other elements or features. Thus, the exemplary term "upper" can encompass both an orientation of above and below. The device may be otherwise oriented and the spatially relative descriptors used herein are interpreted accordingly.

The invention will now be described in greater detail, by way of example, with reference to the drawings. It should be noted that these figures illustrate longitudinal cross-sections of the aerosol container, which are symmetrical. As such, components of the aerosol container and processes that occur within that are labelled shall also be mirrored and applied to their unlabelled counterparts.

Figure 2:
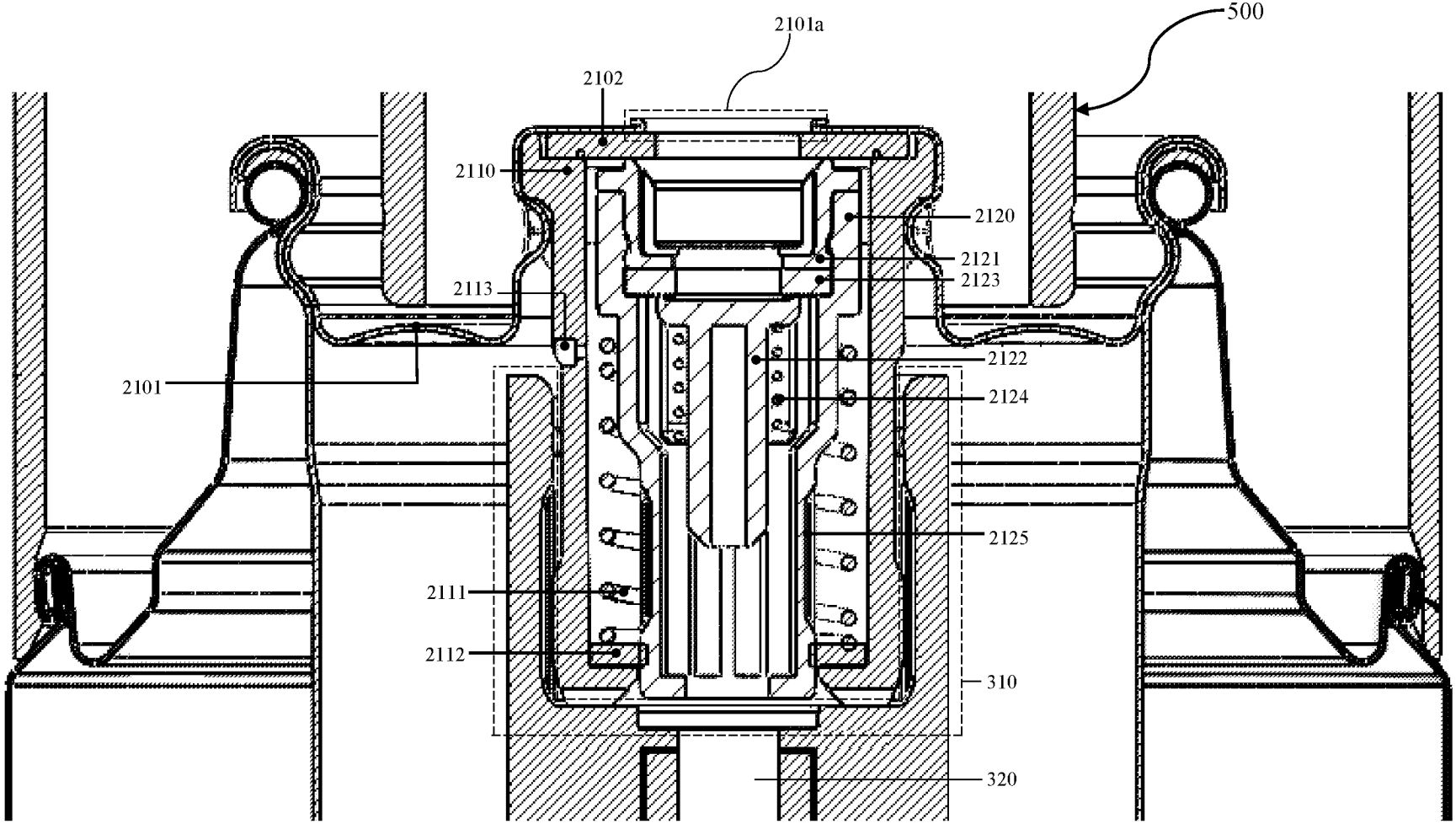
FIG. 2 is a zoomed-in diagram of FIG. 1 focusing on the first aerosol valve assembly on the aerosol container.

FIG. 1 illustrates a cross-sectional view of the aerosol container, comprising the body 100 and the first aerosol valve assembly 2100. Whereas FIG. 2 is an illustration that specifically focuses on the first aerosol valve assembly 2100 and its related components.

From FIG. 1 as well, the body 100 is preferably cylindrical, having a hollow outer compartment 110, and the inner walls of the outer compartment 110 make up an outer chamber 110*a*. Preferably, the outer compartment 110 is of metallic material that is strong enough to withstand the pressure exerted by the propellant. The upper portion of outer compartment 110 is tapered and further comprises an opening that allows the accommodation of a hollow inner compartment 120, with the aperture of the inner compartment 120 supported by the rims of the opening. Preferably, before the inner compartment 120 is accommodated within the outer compartment 110, it is pre-filled with content, particularly a payload being a resin component, and the propellant. Alternatively, it may be just be pre-filled with content, being the propellant only. The inner compartment 120 is substantially smaller in diameter and volume compared to the outer compartment 110, and the inner walls of the inner compartment 120 make up the inner chamber 120*a*. The bottom-end portion of the inner compartment 120 is a divider 121 that is preferably made of thin or soft material that is easily punctured or perforated. This may be, but shall not be limited to rubber, polyethene terephthalate (PETE) or the like.

From FIG. 1 as well, it can be seen that the first aerosol valve assembly 2100 further comprises a mounting cup 2101 and a valve housing 2110. The mounting cup 2101 seals the opening of the inner compartment 120 through a crimping process, thus creating a leak-proof space in the inner chamber 120*a* and outer chamber 110*a*. Directly below the first aerosol valve assembly 2100 is a puncture member 300. When coalescing, by means of mixing, of the content of the inner chamber 120*a* and outer chamber 110*a* is desired, the puncture member 300 shall rupture the divider 121 of the inner compartment 120 so that the content of the inner chamber 120*a* shall flow into the outer chamber 110*a* and coalesce. One or more agitator balls 111 may be included within the outer compartment 110 to aid in this process.

From FIG. 1, it can be seen that the first aerosol valve assembly 2100 is seated on a recess 310 formed at an upper portion of the puncture member 300. Preferably, the first aerosol valve assembly 2100 is slidable along the walls of the recess 310, with its conduit connected to a channel 320 of the puncture member 300 that may be formed by a dip tube 321. Alternatively, the dip tube 321 may not be present, and the channel 320 is integrated to be part of the puncture member 300. The lower-end portion of the puncture member 300 further contains one or more projections 330 that would allow the puncture member 300 to rupture the divider 121 of the inner compartment 120 when coalescing of content, which are payload components, is required.

From FIG. 1 and FIG. 2, with the first aerosol valve assembly 2100 in full view, it can be seen that the mounting cup 2101 has another aperture 2101*a*. Adjacent to said aperture 2101*a* and within the inner compartment 120 there is a valve housing 2110 that is conjoined to the aperture 2101*a* with a first gasket seal 2102 in-between. The valve housing 2110 has a hollow cylindrical body that houses the principle components of the valve of the aerosol container, and within it, there is a tubular valve core 2120 that is sleeved within a first resilient member 2111, which may be a spring or any form of elastic device. Such a configuration shall allow a vertical displacement of the valve core 2120 within the confines of the valve housing 2110. The valve housing 2110 is formed with an annular base protruding inwardly at its lower-end portion, where the first resilient member 2111 rests thereon with a third gasket seal 2112 in-between. Furthermore, disposed around the middle portion of the valve housing 2110 and slightly above the recess 310 is a side hole 2113.

From FIG. 2, the valve core 2120 itself has a hollow cylindrical body, but it has different diameters at each of its upper-end and lower-end portions to assume a shape similar to a reducing socket. The valve core 2120 further comprises cap portion 2121 and a valve shaft 2122 disposed within, with a second gasket seal 2123 in-between the cap portion 2121 and the valve shaft 2122. The valve shaft 2122 is tubular and is sleeved within a second resilient member 2124 within the valve core 2120. The second resilient member 2124 is similar to the first resilient member 2111, being a spring as well. Such a configuration allows a vertical displacement of the valve shaft 2122 within the confines of the valve core 2120. As the valve shaft 2122 is displaced vertically downwards, an inlet is formed between the valve shaft 2122 and the second gasket seal 2123 that allows an inflow of external content, preferably a payload being a hardener component, into the body 100. Furthermore, the cap portion 2121 is configured to be able to influence the displacement of the entire valve core 2120 or just the valve shaft 2122 in the valve core 2120. This is because the cap portion 2121 is formed with an annular base protruding inwardly from its bottom-end portion. Finally, near the bottom-end portion of the valve core 2120 with a smaller diameter, there are areas on the external walls of the valve core 2120 that are formed with indented portions 2125.

From FIG. 1 and FIG. 2, it is shown that the aerosol container is in an inert state suitable for storage after being manufactured. To configure the aerosol container to be in such a state, it is required that a fastening device 500 is rested on the top of the aerosol container, in particular, on top of the mounting cup 2101 of the first aerosol valve assembly 2100. The fastening device 500 does not have any stem of sorts that would cause a positional change in the entire valve core 2120 or just the valve shaft 2122 in the valve core 2120. As the resilient members 2111, 2124 of the first aerosol valve assembly 2100 actively push the components of the first aerosol valve assembly 2100 against the gasket seals 2102, 2123, there is no leakage of the content from the aerosol container. The fastening device 500 also protects the aperture 2101*a* of the first aerosol valve assembly 2100 from any foreign objects, especially rod-like objects, which may cause accidental displacement of the components of the first aerosol valve assembly 2100.

Figure 3:
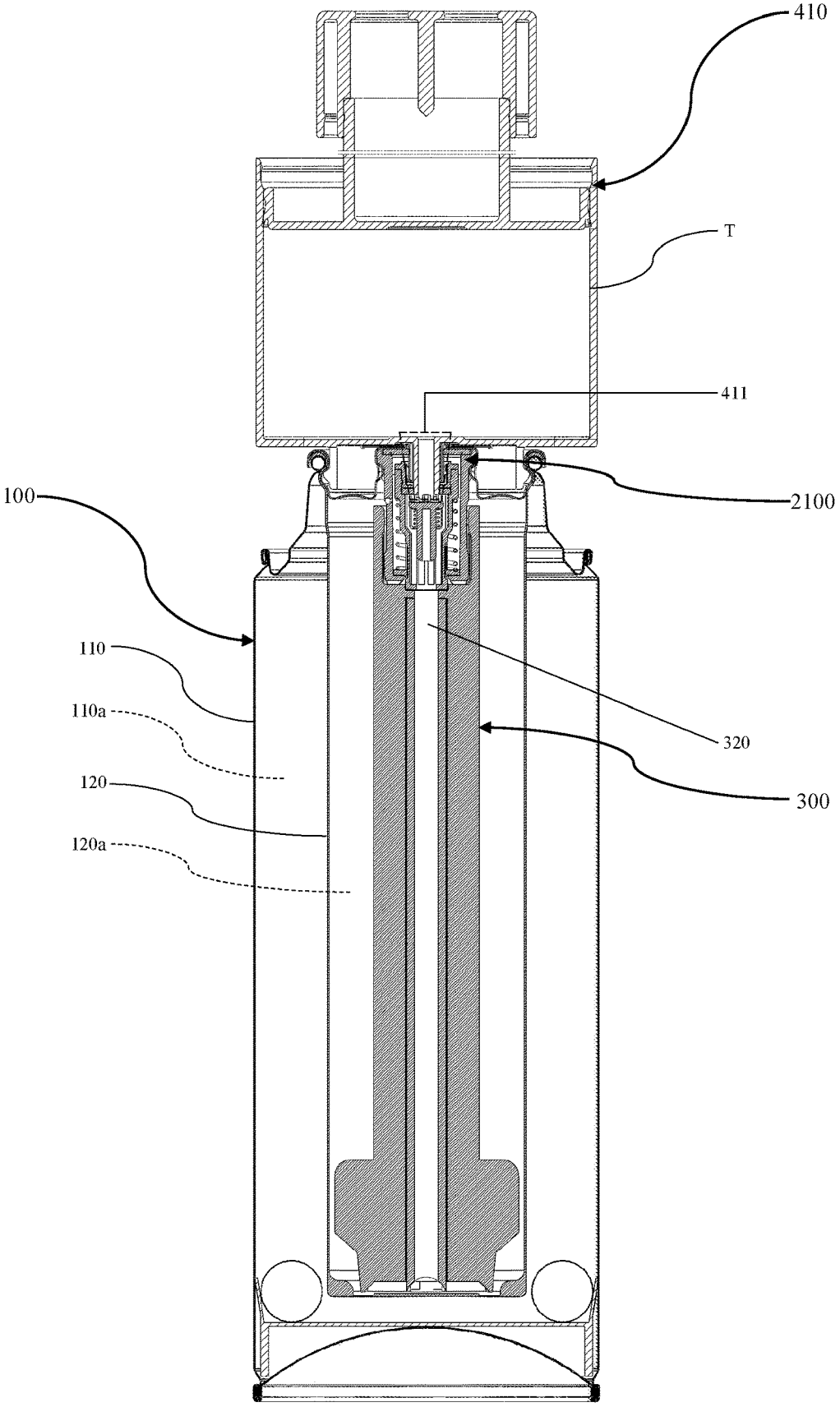
FIG. 3 is a diagram illustrating the cross-sectional view of the aerosol container and the first aerosol valve assembly in an activated state that allows operation of the content-filling mechanism and gas-discharging mechanism.
Figure 4:
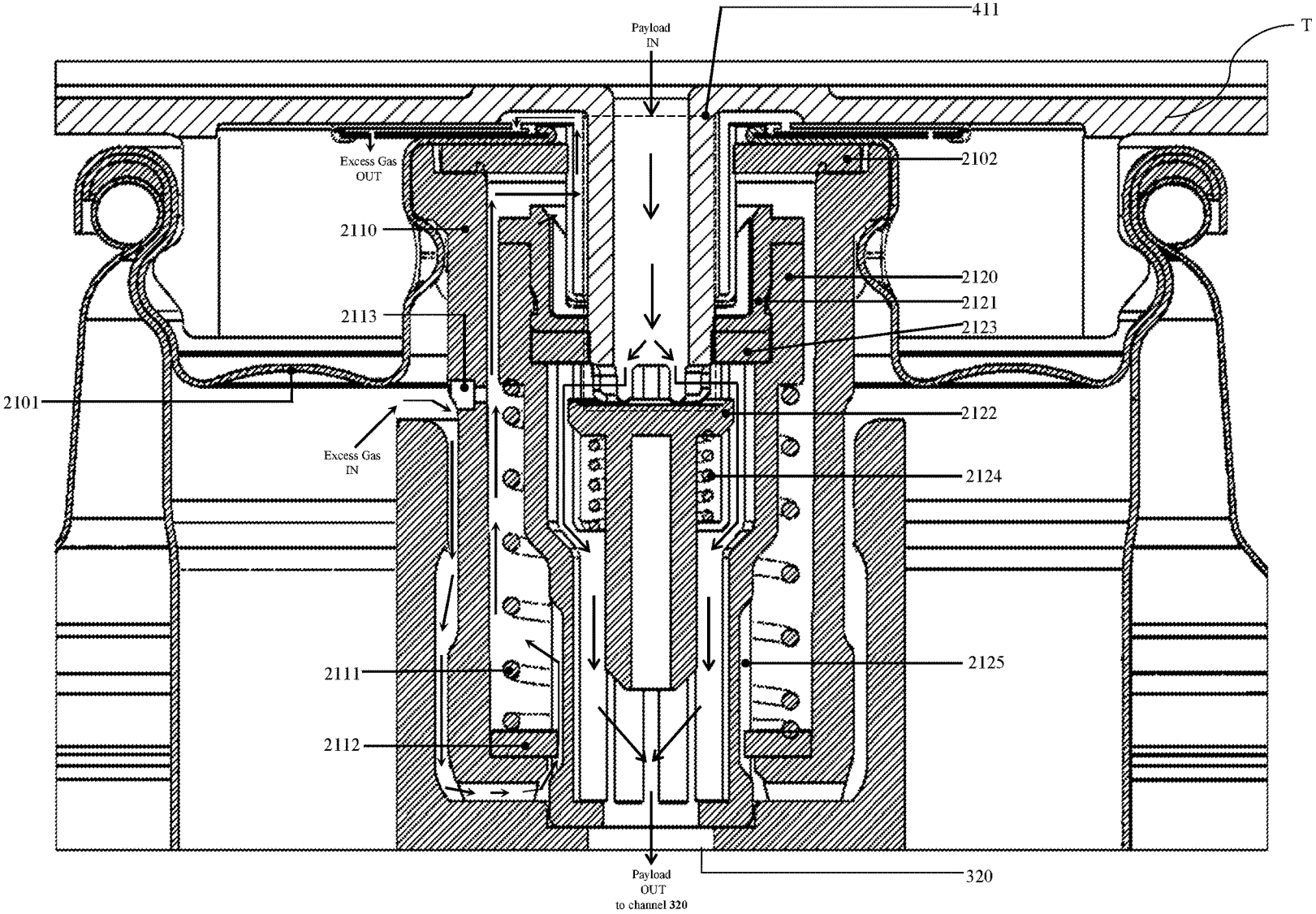
FIG. 4 is a zoomed-in diagram of FIG. 3 focusing on the first aerosol valve assembly on the aerosol container for illustrating the content-filling path and the gas-discharge path.

With reference to FIG. 3 and FIG. 4, the content-filling mechanism (I) and gas-discharging mechanism (II) involving the first aerosol valve assembly 2100 and a content-filling-and-gas-discharging device 410 shall now be described in detail. FIG. 3 illustrates a cross-sectional view of the aerosol container and the first aerosol valve assembly 2100, activated by the attached content-filling-and-gas-discharging device 410. FIG. 4 illustrates a zoomed-in view of FIG. 3 that shows the flow of external content, preferably a payload being a hardener component, entering the aerosol container and excess gas exiting the aerosol container when said device 410 activates the first aerosol valve assembly 2100. While the content-filling mechanism (I) and gas-discharging mechanism (II) are to be described to operate simultaneously, it is not limited to such an embodiment. In an alternative embodiment, the content-filling mechanism (I) and gas-discharging mechanism (II) may operate independently from each other through the use of a content-filling device or a gas-discharging device separately.

Referring to FIG. 3, the content-filling-and-gas-discharging device 410, having a content-filling-and-discharge activation stem 411, is shown. This device 410 allows for the simultaneous operation of the content-filling mechanism (I) and gas-discharging mechanism (II). Preferably, the content-filling-and-gas-discharging device 410 is part of a filling tank T. The aerosol container may be in the aerosol container manufacturing line where a component (such as the hardener component) is to be filled into the inner chamber 120*a*. Preferably, before activation, the content-filling-and-discharge activation stem 411 is to be directly positioned to be above the aperture 2101*a* of the mounting cup 2101 of the first aerosol valve assembly 2100 that leads to the valve housing 2110 within the aerosol container.

Referring to FIG. 3, the first aerosol valve assembly 2100 is activated when the aperture 2101*a* of the mounting cup 2101 is penetrated by the activation stem 411 of the content-filling-and-gas-discharging device 410. This allows content-filling mechanism (I) and gas-discharging mechanism (II) to operate. Preferably, the activation stem 411 is tapered, or extends telescopically, for its body has varying diameters to allow it to vertically displace both the valve core 2120 and the valve shaft 2122 in the valve core 2120.

Referring to FIG. 4, the thinner portion of the activation stem 411 vertically displaces the valve shaft 2122 of the valve core 2120, forming a gap between the valve shaft 2122 and the second gasket seal 2123. With this, the content-filling-and-gas-discharging device 410 provides an inflow of external content, preferably a payload being a hardener component or a single component payload, into the aerosol container as per the content-filling mechanism (I).

Referring to FIG. 4 as well, the thicker portion of the activation stem 411 vertically displaces the valve core 2120 itself until its bottom-end portion slightly extrudes outwardly from the valve housing 2110, leaving behind a gap between the first gasket seal 2102 and the upper-end portion of the cap portion 2121 of the valve core 2120. The length of the activation stem 411 is configured so that it does not vertically displace the valve core 2120 until it displaces the puncture member 300 to cause the divider 121 to rupture. Moreover, as the activation stem 411 vertically displaced the valve core 2120, its indented portions 2125 slightly protrudes out from the valve housing. With this, the content-filling-and-gas-discharging device 410 provides degassing of the aerosol container as per the gas-discharging mechanism (II).

FIG. 4 further illustrated the flow passages that are formed. In particular, there are two flow passages shown in FIG. 4: a content-filling passage (the path shown in the "→" arrows) and a gas-discharge passage (the path shown in the "⇝" arrows). The components involved in the content-filling passage form the content-filling mechanism (I), while the components involved in the gas-discharge passage form the gas-discharging mechanism (II).

Regarding the content-filling passage shown in FIG. 4, it is the passage where the external content from the tank L undertakes to fill the inner chamber 120*a*. The path of the content-filling passage begins at the gap is formed between the valve shaft 2122 and the second gasket seal 2123. Next, the external content flows through the internal walls of the valve core 2120 (since the valve core 2120 is hollow) and reaches the bottom-end portion of the valve core 2120. Finally, the external content flows through the channel 320 of the puncture member 300 so that it fills the vicinity of the inner chamber 120*a*. With this, the description of the content-filling mechanism (I) is complete.

Regarding the gas-discharge passage shown in FIG. 4, it is the passage where excess gas, which may be present in the inner chamber 120*a*, exits the aerosol container. This creates a pseudo-vacuum environment within the inner chamber 120*a* with little to no gas that may cause oxidation of the external content filled in the inner chamber 120*a*. The path of the gas-discharge passage begins at the gap formations between the mounting cup 2101 and the puncture member 300 whereby the excess gas enters therein. Next, the excess gas travels through the walls of the recess 310 of the puncture member 300 and the external walls of the valve housing 2110. Following this, the excess gas enters the valve housing 2110 through the indented portions 2125 of the valve core (since the indented portions 2125 have protruded out as well). After this, the excess gas travels within the valve housing 2110 of the aerosol container, through the internal walls of the valve housing 2110 and the external walls of the valve core 2120. Also, the presence of the side hole 2113 may serve to further enhance the gas-discharging mechanism (II) by allowing the discharge of the excess gas through the provision of a direct path for the excess gas to enter the valve housing 2110. Then, the excess gas travels upwards until it reaches the gap between the first gasket seal 2102 and the upper-end portion of the cap portion 2121 of the valve core 2120. Once the excess gas reaches this area, it exits the aerosol container through a discharge conduit 412 incorporated with the activation stem 411. Finally, this discharge conduit 412 leads the excess gas out into the environment where it shall be discharged. With this, the description of the gas-discharging mechanism (II) is complete.

Figure 5:
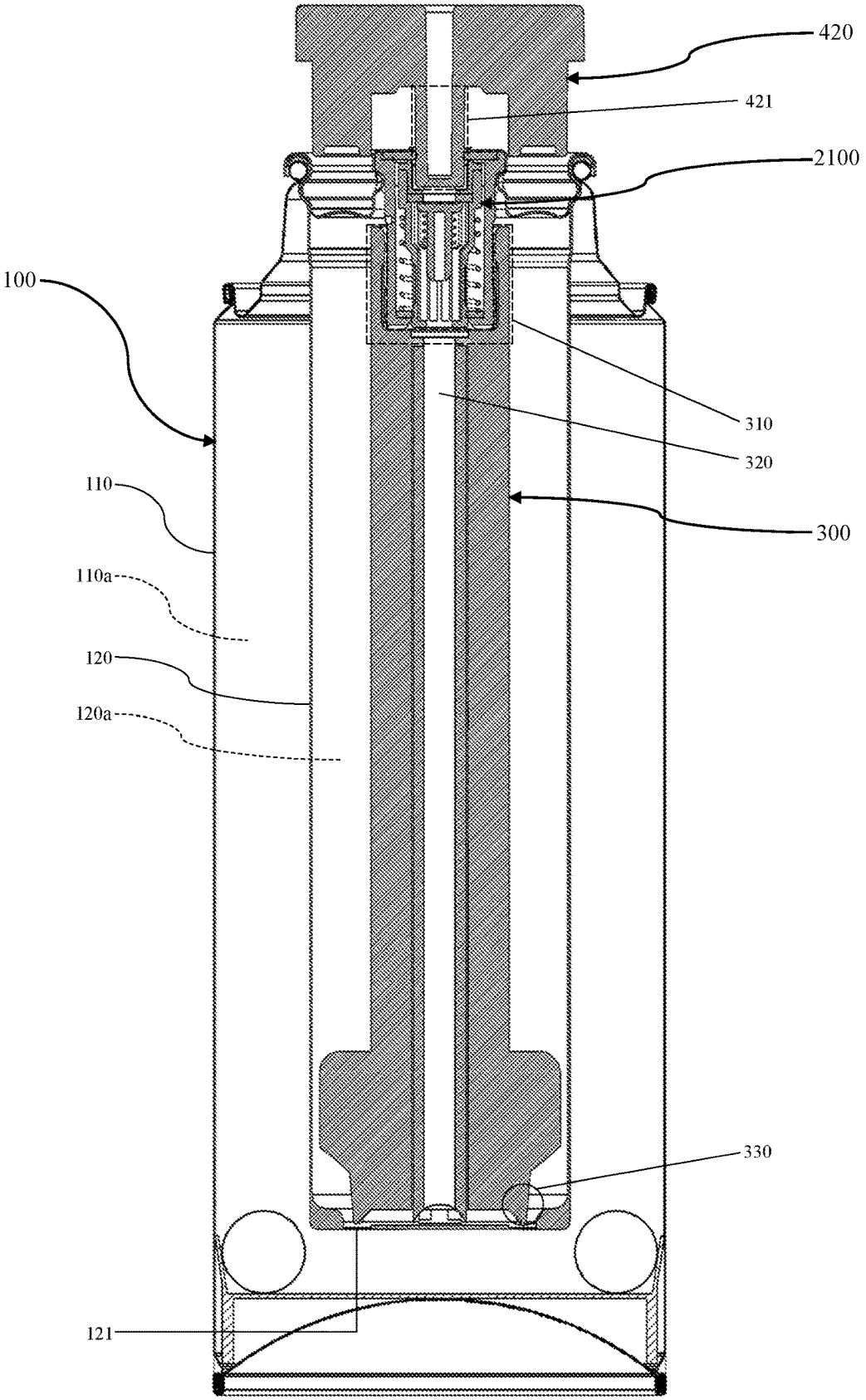
FIG. 5 is a diagram illustrating the cross-sectional view of the aerosol container and the first aerosol valve assembly in a non-activated state, with the rupturing mechanism yet to be operated.
Figure 6:
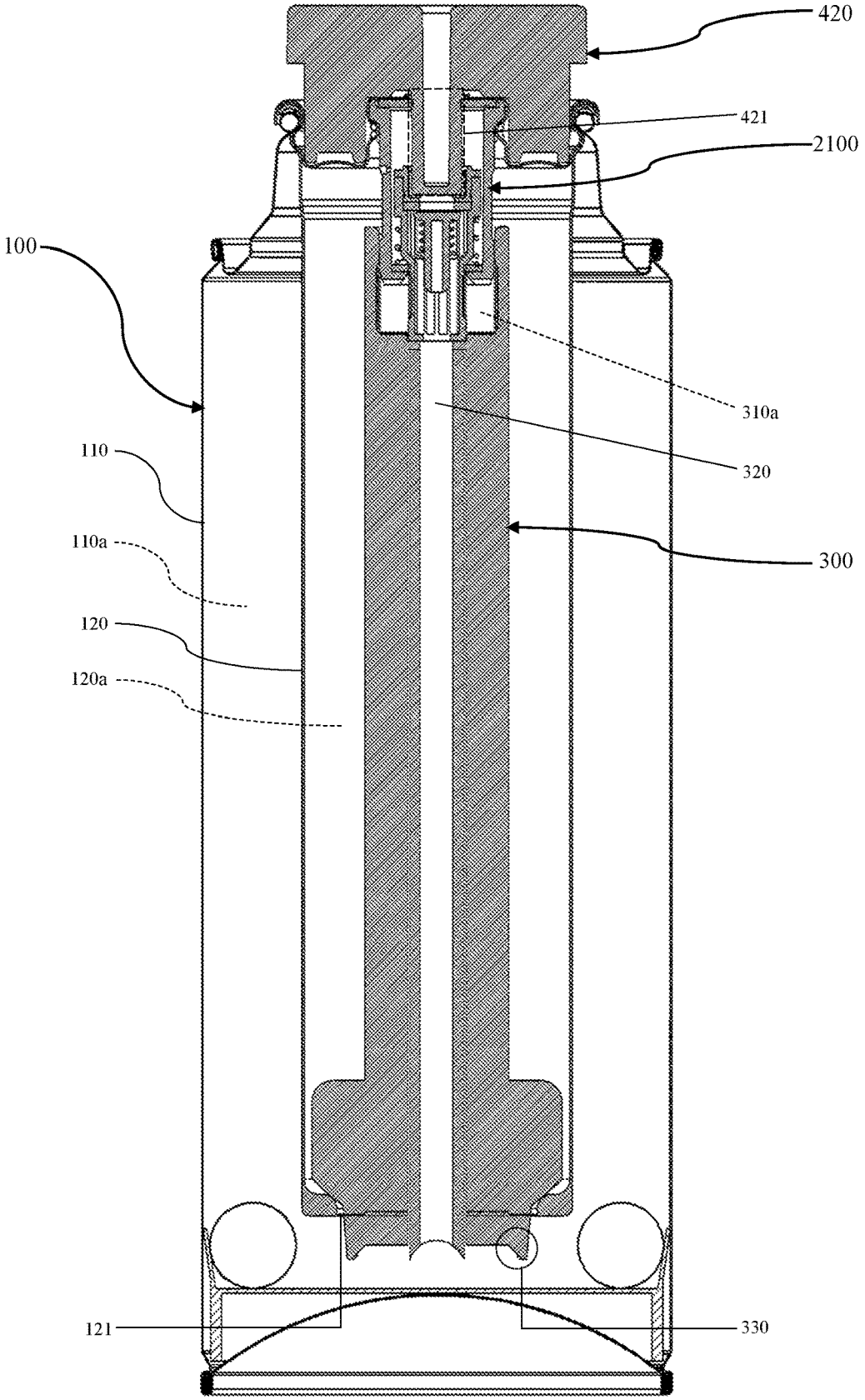
FIG. 6 is a diagram illustrating the cross-sectional view of the aerosol container and the first aerosol valve assembly in an activated state that allows operation of the rupturing mechanism.
Figure 7:
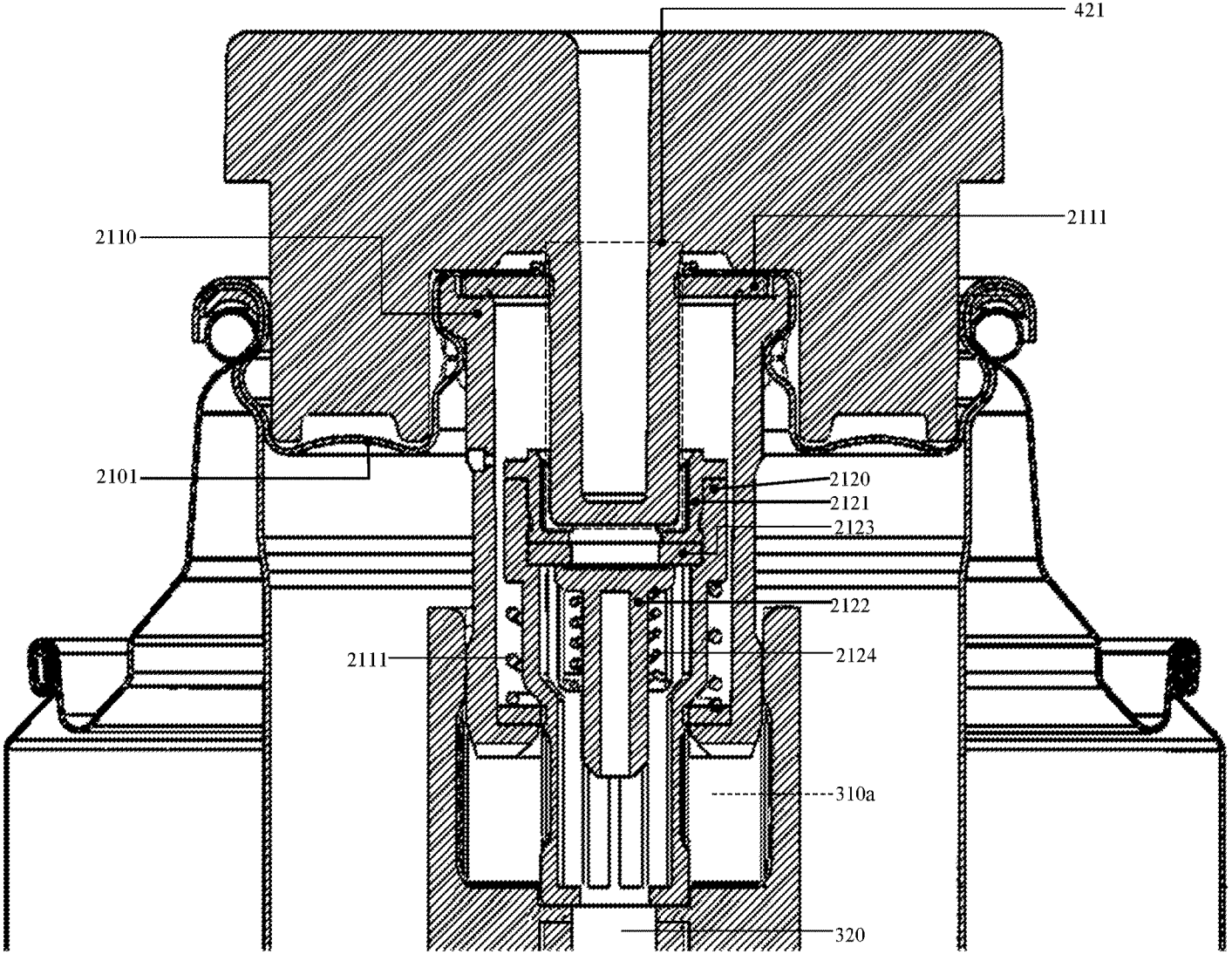
FIG. 7 is a zoomed-in diagram of FIG. 6 focusing on the first aerosol valve assembly on the aerosol container for illustrating the positions of the components after the rupturing mechanism is activated.

With reference to FIG. 5 to FIG. 7, the rupturing mechanism (III) involving the first aerosol valve assembly 2100 and a rupturing device 420 shall now be described. FIG. 5 illustrates a cross-sectional view of the aerosol container and the first aerosol valve assembly 2100 in a non-activated state, but ready to be attached with the rupturing device 420. FIG. 6 illustrates a cross-sectional view of the aerosol container and the aerosol valve assembly 200 in an activated state, attached with the rupturing device 420. FIG. 7 illustrates a zoomed-in view of FIG. 6 that shows the positions of the components of the first aerosol valve assembly 2100 when in the said activated state. Referring to FIG. 5, the rupturing device 420, having a rupture activation stem 421, is shown. This device 420 allows for the operation of rupturing mechanism (III). Preferably, before activation as shown in FIG. 5, the rupture activation stem 421 is directly positioned to be above the aperture 2101*a* of the mounting cup 2101 of the first aerosol valve assembly 2100 that leads to the valve housing 2110 within the aerosol container.

Referring to FIG. 6, the first aerosol valve assembly 2100 is activated when the aperture 2101*a* of the mounting cup 2101 is penetrated by the activation stem 421 of the rupturing device 420. This allows rupturing mechanism (III) to operate. Preferably, the activation stem 421 is not tapered and has a constant diameter. The diameter of the activation stem 421 is large enough such that it at least slightly encompasses the annular base of the cap portion 2121 of the valve core 2120. This shall allow the activation stem 421 to only vertically displace the valve core 2120.

Referring to FIG. 7, the rupture activation stem 421 shall force the entirety of the valve core 2120 to displace downwards. The length of the activation stem 421 is long enough to enable the valve core 2120 to protrude out from the valve housing 2110 and provide a vertical displacement to the puncture member 300 (since the first aerosol valve assembly 2100 rests within the recess 310). This causes the projections 330 to rupture the divider 121 of the inner compartment 120 so that content of the inner chamber 120*a* coalesces, or mixes, with content of the outer chamber 110*a*. In particular, the hardener component in the inner chamber 120*a*, and the resin component and propellant in the outer chamber 110*a*, coalesce or mix. Alternatively, the single-component payload in the inner chamber 120*a* and the propellant in the outer chamber 110*a*, coalesce or mix. This forms a coalesced content. When the puncture member 300 punctures the divider 121, the dip tube 321 reaches the base of the outer compartment 110. With this, the description of the puncture mechanism (III) is complete.

As the rupturing device 420 is taken off from the aerosol container (not shown), the valve core 2110 retracts back into its valve housing due to the first resilient member 2111 and re-assumes a position similar to FIG. 2. However, there will be a permanent positional change for the puncture member 300 within the aerosol container. Unlike FIG. 2, the valve housing 2110 of the aerosol container will not be rested on the recess 310 of the puncture member 300 anymore. As the puncture member 300 has been displaced downwardly in a permanent manner, the recess 310 forms a cavity 310*a*.

Figure 8:
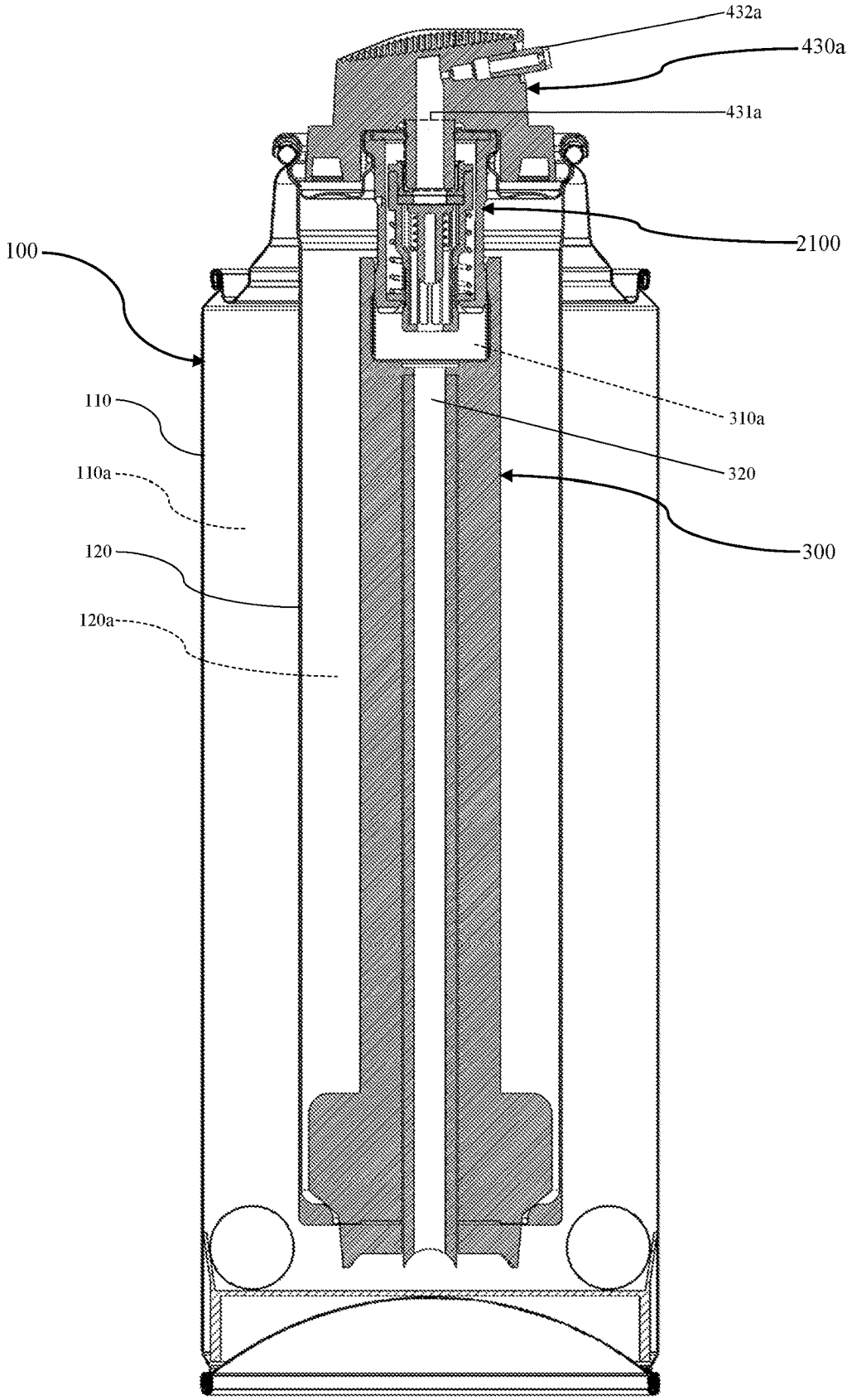
FIG. 8 is a diagram illustrating the cross-sectional view of the aerosol container and the first aerosol valve assembly in an activated state that allows operation of the first content-dispensing mechanism.
Figure 9:
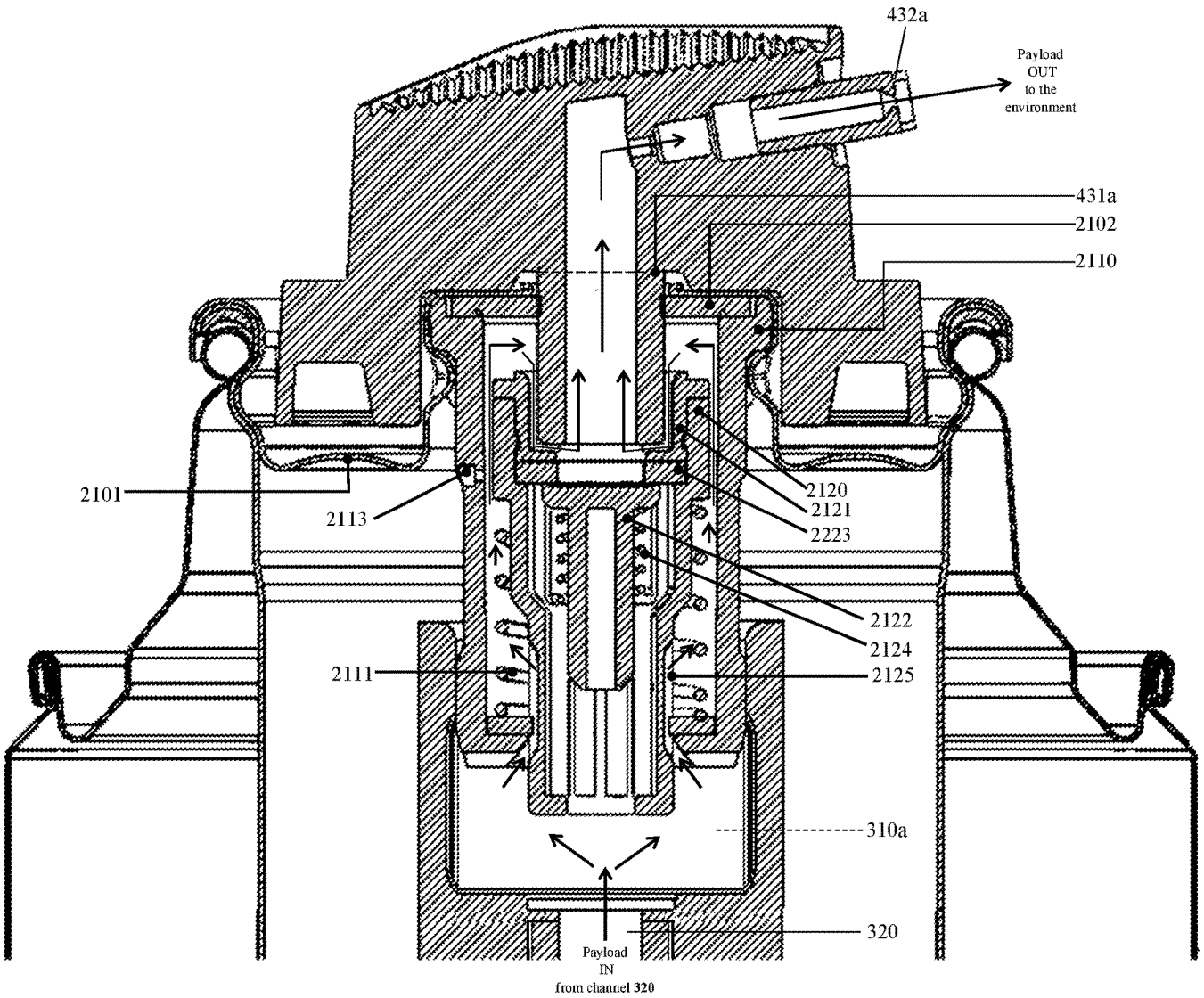
FIG. 9 is a zoomed-in diagram of FIG. 8 focusing on the first aerosol valve assembly on the aerosol container for illustrating the first content-dispensing path.

With reference to FIG. 8 and FIG. 9, the first content-dispensing mechanism (IV) involving the first aerosol valve assembly 2100 and a first content-dispensing device 430*a* shall now be described. FIG. 8 illustrates a cross-sectional view of the aerosol container and the first aerosol valve assembly 2100 in an activated state, attached with the first content-dispensing device 430*a*. FIG. 9 illustrates a zoomed-in view of FIG. 8 that shows the flow of content exiting the aerosol container when the said device 430*a* is in the activated state.

Referring to FIG. 8, the first content-dispensing device 430*a*, having a content-dispensing activation stem 431*a*, is shown. This device 430*a* allows for the operation of the first content-dispensing mechanism (IV). Preferably, the first content-dispensing device 430*a* is similar to a conventional aerosol container spray head, configured for a female-type aerosol valve assembly, and further includes a nozzle and conduits leading to the nozzle. Preferably, before activation, the activation stem 431*a* is to be directly positioned to be above the aperture 2101*a* of the mounting cup 2101 of the first aerosol valve assembly 2100 that leads to the valve housing 2110 within the aerosol container.

Referring to FIG. 9, the first aerosol valve assembly 2100 is activated when the aperture 2101*a* of the mounting cup 2101 is penetrated by the activation stem 431*a* of the first content-dispensing device 430*a*. This allows the first content-dispensing mechanism (IV) to operate. Preferably, the activation stem 431*a* is not tapered and has a constant diameter. The diameter of the activation stem 431*a* is large enough such that it at least slightly encompasses the annular base of the cap portion 2121 of the valve core 2120. This allows the activation stem 431*a* to only vertically displace the valve core 2120.

Referring to FIG. 9 as well, the first content-dispensing activation stem 431*a* in particular vertically displaces the valve core 2120 itself until its bottom-end portion extrudes outwardly from the valve housing 2110 with the indented portions 2125 of the valve core 2120 is exposed as well. The activation stem 431*a* also leaves behind a gap between the first gasket seal 2102 and the upper-end portion of the cap portion 2121 of the valve core 2120. With this, the first content-dispensing device 430*a* provides degassing of the aerosol container as per the first content-dispensing mechanism (IV).

FIG. 9 further illustrates flow passages that are formed. In particular, there is one flow passage shown in FIG. 9, which is a first content-dispensing passage (the path shown in the "→" arrows). The components involved in the first content-dispensing passage forms the first content-dispensing mechanism (IV).

Regarding the first content-dispensing passage shown in FIG. 9, it is the passage where the coalesced content within the aerosol container undertakes to be dispensed out into the environment through the nozzle 432*a*. In the activated state as per FIG. 8, a differential pressure is created between the environment and the pressurized interior of the aerosol container due to the presence of the propellant. As such, the path of the first content-dispensing passage begins at the bottom-end portion of the dip tube 321 that is now located at the base of the inner compartment 120 where the coalesced content is drawn thereto. Next, the coalesced content travels upwards along the channel 320 of the dip tube 321 to reach the cavity 310*a*. Following this, the coalesced content enters the valve housing 2110 through the indented portions 2125 of the valve core 2120. Then, the coalesced content travels through the internal walls of the valve housing 2110 and the external walls of the valve core 2120. While it does so, propellant may enter into the valve housing through the side hole 2113 to be further mixed, or undergo secondary mixing, with the coalesced content.

Once the coalesced content reaches the gap formed between the first gasket seal 2102 and the upper-end portion of the cap portion 2121 of the valve core 2120, the coalesced content then squeezes through conduits formed between the external walls of the content-dispensing activation stem 431*a* and the walls of the cap portion 2121 to reach an inlet of the activation stem 431*a*. Finally, the coalesced content goes through the conduit of the first content-dispensing device 430*a* to reach the nozzle 432*a* for it to be dispensed out into the environment. The further mixing, or secondary mixing between the coalesced content and the propellant that had entered through the side hole 2113 may provide a uniform dispensation of the coalesced content for a better spray effect. With this, the description of the first content-dispensing mechanism (IV) is complete.

The first aerosol valve assembly 2100 of the aerosol container of the present invention may allow the aerosol container to be re-filled in the future after its content have been used up. However, by the time the rupturing mechanism (III) is activated, the positional configuration of components within the aerosol container undergoes an irreversible change, and as such the aerosol container may only be re-filled with content such as a payload being single-component paint.

Figure 10:
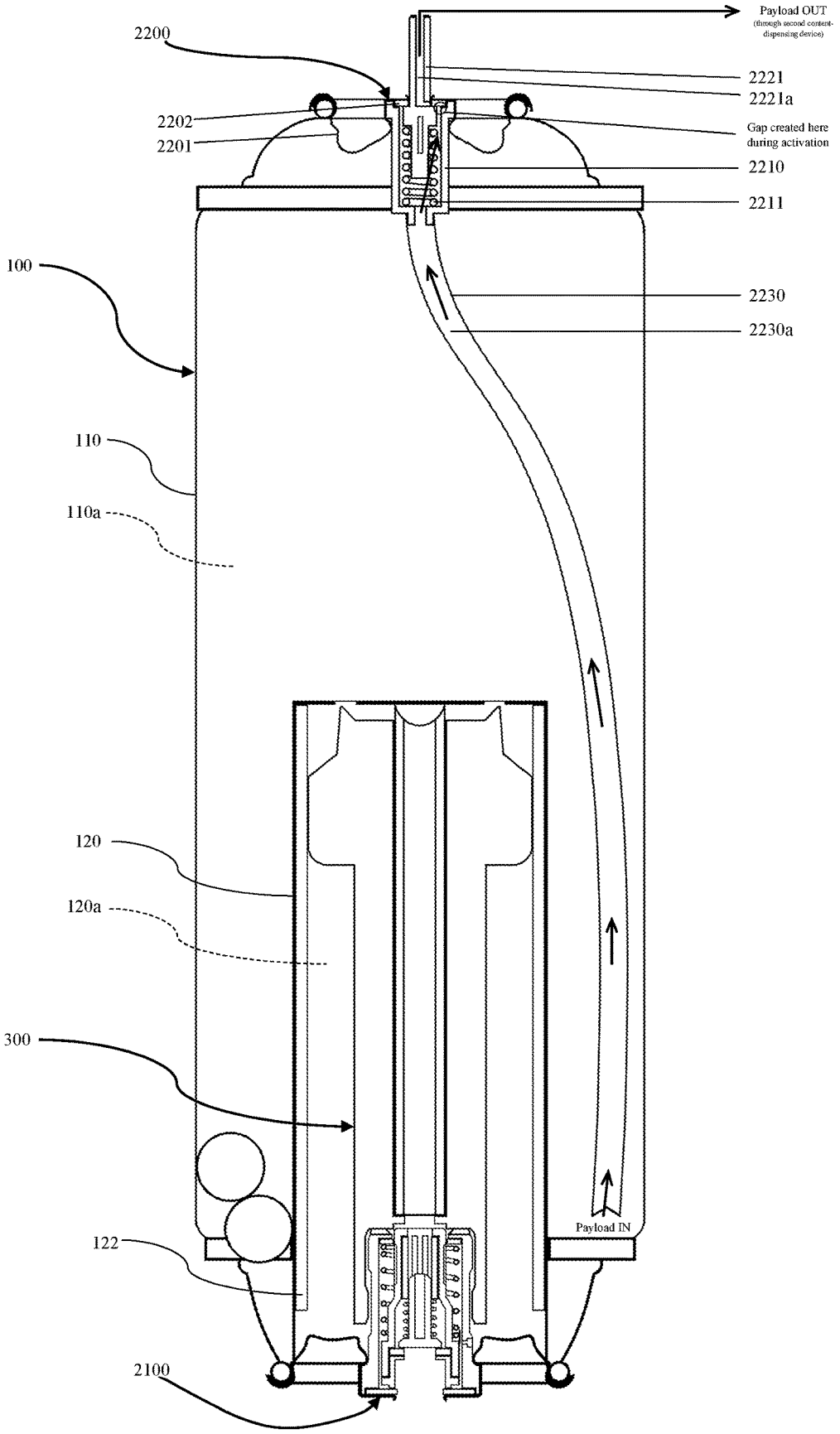
FIG. 10 is a diagram illustrating the cross-sectional view of the aerosol container which includes the first aerosol valve assembly and a second aerosol valve assembly of the male-type.

FIG. 10 illustrates the cross-sectional view of an aerosol container, which includes the first aerosol valve assembly 2100 and a second aerosol valve assembly 2200. The body 100 of this aerosol container has an outer compartment 110 defined with an outer chamber 110*a* having two open ends. Preferably, the first aerosol valve assembly 2100 is located at the upper-end portion of the aerosol container, in the vicinity of a first open end of the outer chamber 110*a*. Preferably, the second aerosol valve assembly 2200 is located at the bottom-end portion of the aerosol container, in the vicinity of a second open end of the outer chamber 110*a*.

Preferably, the first aerosol valve assembly 2100 is substantially connected and within an inner chamber 120*a* of an inner compartment 120, and also connected to a puncture member 300. It is configurationally and functionally similar to the aerosol valve assembly as previously described based on FIGS. 1 to 9. Additionally, the inner chamber 120*a* may further include a reinforcement structure 122 for reinforcing the structural integrity of the inner chamber 120*a*. This is to enable the inner chamber 120*a* to sustain internal pressure within itself and withstand compression forces that may occur during the operation of the content-filling mechanism (I). Preferably, this reinforcement structure 122 is sleeved into the inner compartment 120. Preferably as well, the reinforcement structure 122 allows the inner chamber 120*a* to withstand at least 50N of force. With this, deformation of the inner chamber 120*a* may be avoided.

Whereas, the second aerosol valve assembly 2200 is of a male type, and it comprises a mounting cup 2201, a valve housing 2210 with a valve core 2220 therewithin, and a dip tube 2230. Preferably, the mounting cup 2201 is mounted to the second open end of the outer chamber 110*a*. Preferably, the valve housing 2210 is supported onto the outer chamber 110*a* through the mounting cup 2201 with a gasket seal 2202 disposed therebetween. Within the valve housing 2210, the valve core 2220 is sleeved within a resilient member 2211. Not only that, the valve core 2220 further includes a valve stem 2221, having a channel 2221*a* therewithin, which protrudes outwardly from the valve housing 2210 and mounting cup 2201. Preferably, the dip tube 2230 is connected to the bottom-end portion of the valve housing 2210 and its bottom-end portion leads to the bottom-end portion of the aerosol container.

With reference to FIG. 10, the second content-dispensing mechanism (V) involving the second aerosol valve assembly 2200 shall now be described. Preferably, the second aerosol valve assembly 2200 shall receive a content-dispensing activation stem of a second content-dispensing device (not shown) that shall allow the operation of the second content-dispensing mechanism (V). The second content-dispensing device is preferably similar to a conventional aerosol spray head configured for a male-type aerosol valve assembly, and further includes a nozzle and conduits leading to the nozzle.

Preferably, before activation, the activation stem of the second content-dispensing device is to be directly positioned to be above the mounting cup 2201 of the second aerosol valve assembly 2200, with the valve stem 2221 of the valve core 2220 tightly fitted into or over the content-dispensing activation stem of the second content-dispensing device.

The second aerosol valve assembly 2200 is activated when the content-dispensing activation stem of the second content-dispensing device causes a downward displacement of the valve stem 2221. This will then cause the valve core 2220 to have a downward displacement as well. Consequently, a gap shall be formed between the mounting cup 2201 and the gasket seal 2202, which leads to the channel 2221*a* of the valve stem 2221. This shall allow the dispensing of content from the outer chamber 110*a*, which may be the originally uncoalesced content of the outer chamber 110*a*, or coalesced content should the divider 121 had been punctured.

FIG. 10 further illustrates flow passages that may be formed. In particular, there is one flow passage shown in FIG. 10, which is a second content-dispensing passage (the path shown in the "→" arrows). The components involved in this second content-dispensing passage forms the second content-dispensing mechanism (V).

Regarding the second content-dispensing passage shown in FIG. 10, it is the passage where content within the aerosol container undertakes to be dispensed out into the environment through a nozzle. As the second aerosol valve assembly 2200 assumes an activated state due to the content-dispensing activation stem of the second content-dispensing device, a differential pressure is created between the environment and the pressurized interior of the aerosol container due to the presence of the propellant. As such, a path of the second content-dispensing passage begins at the bottom-end portion of the dip tube 2230 located within the bottom-end portion of the aerosol container, where the content is drawn thereto. Next, the content travels along a channel 2230*a* of the dip tube 2230 to reach the valve housing 2210.

Once the content reaches the valve housing 2210, the content shall proceed to the gap formed between the mounting cup 2201 and the gasket seal 2202 so that it reaches the channel 2221*a* of the valve stem 2221.

After that, while not shown, the content will exit the valve stem 2221 and enter the content-dispensing activation stem of the second content-dispensing activation device. The content may then go through conduits of the second content-dispensing device to reach its nozzle, for the content to then be dispensed out into the environment. With this, the description of the second content-dispensing mechanism (V) of the embodiment of the aerosol container as illustrated in FIG. 10 is complete.

Figure 11:
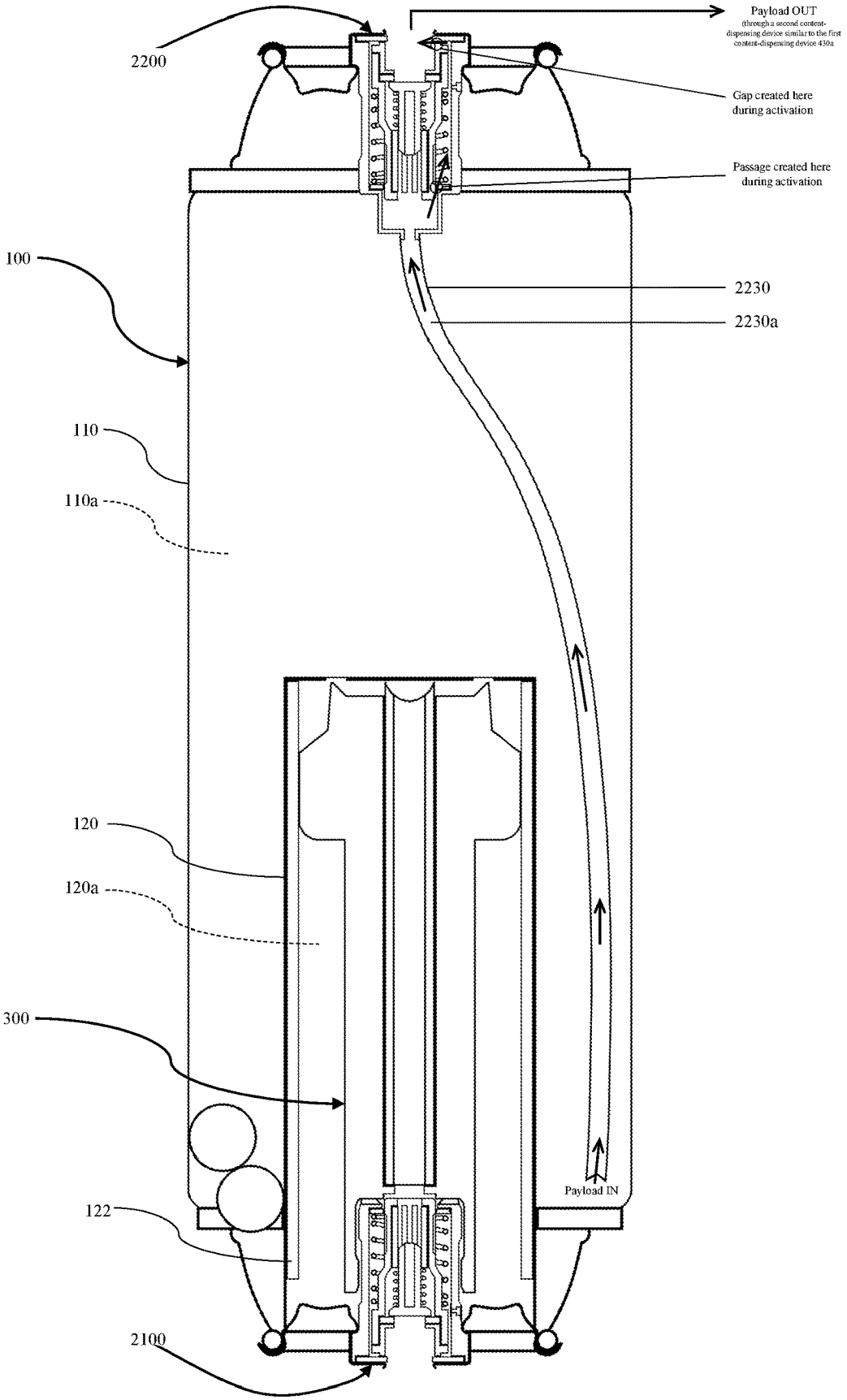
FIG. 11 is a diagram illustrating the cross-sectional view of the aerosol container which includes the first aerosol valve assembly and a second aerosol valve assembly that bears similarities with the first aerosol valve assembly.

It is noted that the embodiment of the second aerosol valve assembly 2200 illustrated in FIG. 10 and its descriptions thereof may also apply if it is of the female type as well, which is illustrated in FIG. 11.

In the embodiment of the aerosol container as illustrated in FIG. 11, the second aerosol valve assembly 2200 may be similar to the first aerosol valve assembly 2100 as previously described based on FIGS. 1 to 9, but its valve housing slightly modified to have a longer length compared to before to accommodate the displacement of the valve core when the second aerosol valve assembly 2200 is activated, and also, its valve housing is directly connected to a dip tube 2230 instead of the puncture member 300 and its components. In this embodiment as well, the second aerosol valve assembly 2200 may be activated by another content-filling-and-gas-discharging device, which may be similar to the content-filling-and-gas-discharging device 410, similarly as previously described for FIGS. 3 and 4. This another content-filling-and-gas-discharging device shall allow the operation of another content-filling mechanism (VI) so that content, such as payload or propellant, is filled into the aerosol container.

In this embodiment as well, the second aerosol valve assembly 2200 may be activated by a second content-dispensing device, which may be similar to the first content-dispensing device 430*a*, similarly as previously described for FIGS. 8 and 9. This second content-dispensing device shall allow the operation of a second content-dispensing mechanism (V) so that content is dispensed out into the environment.

FIG. 11 further illustrates flow passages that may be formed. In particular, there is one flow passage shown in FIG. 11, which is the second content-dispensing passage (the path shown in the "→" arrows). The components involved in this second content-dispensing passage form the second content-dispensing mechanism (V) of the embodiment of the aerosol container as illustrated in FIG. 11.

Since the operation of the second content-dispensing mechanism (V) of the aerosol container as illustrated in FIG. 11 is similar to the operation of the first content-dispensing mechanism (IV) as described previously based on FIGS. 8 and 9, it may be regarded that the description of the second content-dispensing mechanism (V) of the embodiment of the aerosol container as illustrated in FIG. 11 is sufficiently supported.

It should be noted that either one or both of the content-filling mechanism (I) of the first aerosol valve assembly 2100, and the another content-filling mechanism (VI) of the second aerosol valve assembly 2200 (when it is of the embodiment of FIG. 11), allows for content, which includes payload and propellant, to be re-filled into the aerosol container. The content-filling mechanism (I) of the first aerosol valve assembly 2100 may allow re-filling of content after the rupturing of the divider (121). This shall reduce the generation of environmental waste as the aerosol container can be reused multiple times. The content-filling mechanisms, when allowing for the refilling of content, are not to impede the operation of the gas-discharging mechanism (II).

Ultimately, the present invention has provided an aerosol container, which is compatible to have a single-component payload or multi-component payload, being able to support filling of content, degassing of air from the aerosol container, coalescing of content and dispensing of content using the same first aerosol valve assembly 2100. Said first aerosol valve assembly 2100 provides means to activate a content-filling mechanism, a gas-discharging mechanism, a rupturing mechanism, a first content-dispensing mechanism, or any combination thereof.

Ultimately as well, the present invention has also provided an aerosol container, which is compatible to have a single-component payload or multi-component payload, being able to support dispensing of content using the second aerosol valve assembly 2200. Said second aerosol valve assembly 2200 provides means to activate a second content-dispensing mechanism, enabling the content within the aerosol container to be dispensed. Moreover, the presence of the first aerosol valve assembly 2100, having a content-filling mechanism (I), allows for refilling of content, which includes payload or propellent, into the aerosol container, thereby making the aerosol container reusable.

The present disclosure includes as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the invention.

The invention claimed is:

1. An aerosol container, comprising:

a body that includes:

an outer chamber having a first open end and a second open end; and an inner chamber positioned within the outer chamber and enclosing the first open end of the outer chamber, the inner chamber having a divider that separates it from the outer chamber, and an opening;

a puncture member for rupturing the divider;

a first aerosol valve assembly enclosing the opening of the inner chamber and including a content-filling mechanism, and, a gas-discharging mechanism; and a second aerosol valve assembly enclosing the second open end of the outer chamber having a second content-dispersing mechanism;

wherein, upon activation of the first aerosol valve assembly, the content-filling mechanism enables formation of a content-filling passage to allow external content to be added into the body, and the gas-discharging mechanism enables formation of a gas-discharging passage to allow unwanted or excess gas to be released out of the body; and wherein, upon activation of the second aerosol valve assembly, the second content dispensing mechanism enables formation of a second content-dispensing passage to dispense the content out of the body.

2. The aerosol container according to claim 1, wherein the first aerosol valve assembly comprises;

a mounting cup mounted to the opening of the inner chamber and having an aperture;

a valve housing positioned within the inner chamber and adjacent to the aperture of the mounting cup; and a valve core accommodated within the valve housing, having a cap portion, a valve shaft connected to the cap portion, and an inlet formed between the cap portion and the valve shaft where the valve shaft is movable within the valve core to expose or close the inlet.

3. The aerosol container according to claim 2, wherein the first aerosol valve assembly further comprises a detachable component inserted into the aperture of the mounting cup, being either:

a content-filling device having a content-filling stem;

a gas-discharging device having a discharge activation stem;

a content-filling and gas-discharging device having a content-filling and a discharge activation stem;

a rupturing device having a rupture activation stem; or, a first content-dispensing device having a content-dispensing activation stem.

4. The aerosol container according to claim 3, wherein the content-filling mechanism of the first aerosol valve assembly includes the valve shaft, and the valve core with the cap portion being configured to receive the content-filling stem therethrough for supplying the external content into the valve core while pushing the valve shaft to expose the inlet of the valve core for directing the external content through the valve core and into the inner chamber.

5. The aerosol container according to claim 4, wherein the content-filling passage includes the content-filling device, the valve core of the first aerosol valve assembly, a channel formed by a dip tube within the puncture member that is connected to the valve core of the first aerosol valve assembly, and the inner chamber.

6. The aerosol container according to claim 3, wherein the gas-discharging mechanism of the first aerosol valve assembly includes the valve shaft, and the valve core with the cap portion configured to receive the discharge activation stem for moving the valve core away from the aperture of the mounting cup to create a gap therebetween to allow exit of the unwanted or excess gas from the body of the aerosol container through the gas-discharging device.

7. The aerosol container according to claim 6, wherein the gas-discharging passage includes, either or both, a combination of the inner chamber, the valve housing of the first aerosol valve assembly and discharge conduits within the gas-discharging device, and a combination of the inner chamber, a passageway formed between the puncture member and the valve housing of the first aerosol valve assembly, the valve core of the first aerosol valve assembly, and the discharge conduits of the gas-discharging device.

8. The aerosol container according to claim 3, wherein the content-filling mechanism and gas-discharging mechanism of the first aerosol valve assembly are configured to operate simultaneously upon activation of the first aerosol valve assembly by the content-filling and discharge activation stem which allows the external content to be supplied from the stem through the cap portion while moving the valve shaft to expose the inlet of the valve core for directing the external content into the valve core, and moving the valve core away from the aperture of the mounting cup to create a gap therebetween to allow exit of the unwanted or excess gas from the body of the aerosol container through the content-filling and gas-discharging device.

9. The aerosol container according to claim 3, wherein a rupturing mechanism of the first aerosol valve assembly includes the valve core, and the valve housing which sits within a recess formed at one end of the puncture member that is slidable along the valve housing such that upon activation of the first aerosol valve assembly by the rupturing activation stem, its valve core is pushed to displace the puncture member towards the direction of the divider to rupture it.

10. The aerosol container according to claim 9, wherein the puncture member further comprises a dip tube forming a channel inside the puncture member that moves along with the puncture member to reach the outer chamber upon rupturing the divider.

11. The aerosol container according to claim 10, wherein the first aerosol valve assembly has its valve core configured to substantially or fully return to its original position within the valve housing upon removal of the rupture activation stem, that disconnects the valve core and the channel of the puncture member, forming a cavity within the puncture member by having the recess covered by the valve housing.

12. The aerosol container according to claim 3, wherein a first content-dispensing mechanism of the first aerosol valve assembly includes the valve housing, and the valve core with the cap portion being configured to receive the content-dispensing activation stem that displaces the valve core away from the aperture of the mounting cup, leaving a gap therebetween to allow content to be dispensed out of the aerosol container through the first content-dispensing device.

13. The aerosol container according to claim 12, wherein the puncture member is formed with a recess at one end that is covered by the valve housing to create a cavity within the puncture member, and has a dip tube forming a channel inside the puncture member.

14. The aerosol container according to claim 13, wherein the first content-dispensing passage includes the body of the aerosol container, the channel within the puncture member, the cavity of the puncture member, the valve housing of the first aerosol valve assembly, conduits between the cap portion of the valve core of the first aerosol valve assembly and the content-dispensing activation stem of the first content-dispensing device, and the first content-dispensing device.

15. The aerosol container according to claim 14, wherein the content-dispensing activation stem of the first content-dispensing device is formed with a dimension to fix the position of the valve core of the first aerosol valve assembly during formation of the gap.

16. The aerosol container according to claim 15, wherein the second aerosol valve assembly comprises:

a mounting cup mounted to the second open end of the outer chamber;

a valve housing mounted to the second open end of the outer chamber through the support of the mounting cup;

a valve core accommodated within the valve housing, having a valve stem that protrudes outwardly from the valve housing and the mounting cup; and a dip tube connected to the valve housing.

17. The aerosol container according to claim 16, wherein the second aerosol valve assembly further comprises a detachable component fitted over its mounting cup and its valve stem, being a second content-dispensing device having a content-dispensing activation stem.

18. The aerosol container according to claim 17, wherein the second content-dispensing mechanism of the second aerosol valve assembly includes the valve core with its valve stem being configured to receive the content-dispensing activation stem of the second content-dispensing device that displaces the valve stem to allow content dispensed out of the aerosol container through the second content-dispensing device.

19. The aerosol container according to claim 18, wherein the second content-dispensing passage includes the body of the aerosol container, the dip tube, the valve housing and the valve stem of the second aerosol valve assembly, the content-dispensing activation stem of the second content-dispensing device, and the second content-dispensing device.

20. The aerosol container according to claim 15, wherein the second aerosol valve assembly comprises:

a mounting cup mounted to the second open end of the outer chamber and having an aperture;

a valve housing positioned adjacent to the aperture of the mounting cup and supported by it;

a valve core accommodated within the valve housing, having a cap portion, and a valve shaft connected to the cap portion; and a dip tube connected to the valve housing.

21. The aerosol container according to claim 20, wherein the second aerosol valve assembly further comprises a detachable component inserted into the aperture of its mounting cup, being a second content-dispensing device having a content-dispensing activation stem.

22. The aerosol container according to claim 21, wherein the second content-dispensing mechanism of the second aerosol valve assembly includes its valve housing, and its valve core being configured to receive the content-dispensing activation stem of the second content-dispensing device that displaces the valve core away from the aperture of the mounting cup, leaving a gap therebetween to allow content to be dispensed out of the aerosol container through the second content-dispensing device.

23. The aerosol container according to claim 22, wherein the second content-dispensing passage includes the body of the aerosol container, the dip tube, the valve housing of the second aerosol valve assembly, conduits between the cap portion of the valve core of the second aerosol valve assembly and the content-dispensing activation stem of the second content-dispensing device, and the second content-dispensing device.

24. The aerosol container according to claim 23, wherein the content-dispensing activation stem of the second content-dispensing device is formed with a dimension to fix the position of the valve core of the second aerosol valve assembly during formation of the said gap.

25. The aerosol container according to claim 24, wherein the inner chamber further comprises a reinforcement structure for reinforcing structural integrity of the inner chamber.

26. The aerosol container according to claim 24, wherein it is refillable through the content-filling mechanism of the first aerosol valve assembly.

* * * * *